US005255493A

United States Patent [19]

Molison et al.

[11] Patent Number: 5,255,493

[45] Date of Patent: Oct. 26, 1993

[54] PACKAGE ASSEMBLY MACHINE AND METHOD

[75] Inventors: Robert E. Molison; Rodger M. Palmer, both of Hanover, Pa.

[73] Assignee: Elsner Engineering Works, Inc., Hanover, Pa.

[21] Appl. No.: 967,694

[22] Filed: Oct. 27, 1992

[51] Int. Cl.[5] ..... B65B 5/04; B65B 39/12

[52] U.S. Cl. ..... 53/473; 53/243; 53/251

[58] Field of Search ..... 53/473, 467, 243, 242, 53/234, 252, 251, 250, 249

[56] References Cited

U.S. PATENT DOCUMENTS

| | | | |
|---|---|---|---|
| 1,513,619 | 10/1924 | Luehrs . | |
| 2,652,670 | 9/1953 | Carrier | 53/134 |
| 3,021,655 | 2/1962 | Chadima et al. | 53/243 |
| 3,323,275 | 6/1967 | Kingsbury et al. | 53/32 |
| 3,541,754 | 11/1970 | Gugler | 53/243 X |
| 3,832,826 | 9/1974 | Ullman | 53/243 X |
| 3,875,724 | 4/1975 | Langen | 53/32 |
| 4,345,682 | 8/1982 | White et al. | 198/635 |
| 4,352,265 | 10/1982 | Hansel et al. | 53/541 |
| 4,392,768 | 7/1983 | Van Capelleveen | 414/278 |
| 4,546,594 | 10/1985 | Mohaupt | 53/243 X |
| 4,645,400 | 2/1987 | Mally et al. | 414/28 |

*Primary Examiner*—James F. Coan
*Attorney, Agent, or Firm*—Thomas Hooker

[57] ABSTRACT

A package assembly machine and method for continuously placing articles in open hollow containers to form packages. A transport unit mounted on an endless conveyor moves an article from a pick up station to a package assembly station where the article is placed in an inverted hollow container to form the package. The package is moved by the transport unit along the endless conveyor and turned upside down. As the package is turned, a hook-shaped circumferential lip on the container engages the lip of a support plate of the transport unit and supports the package. The right side up package is carried to a takeaway station and placed on a discharge conveyor for movement to a sealing machine.

26 Claims, 8 Drawing Sheets

FIG. 9
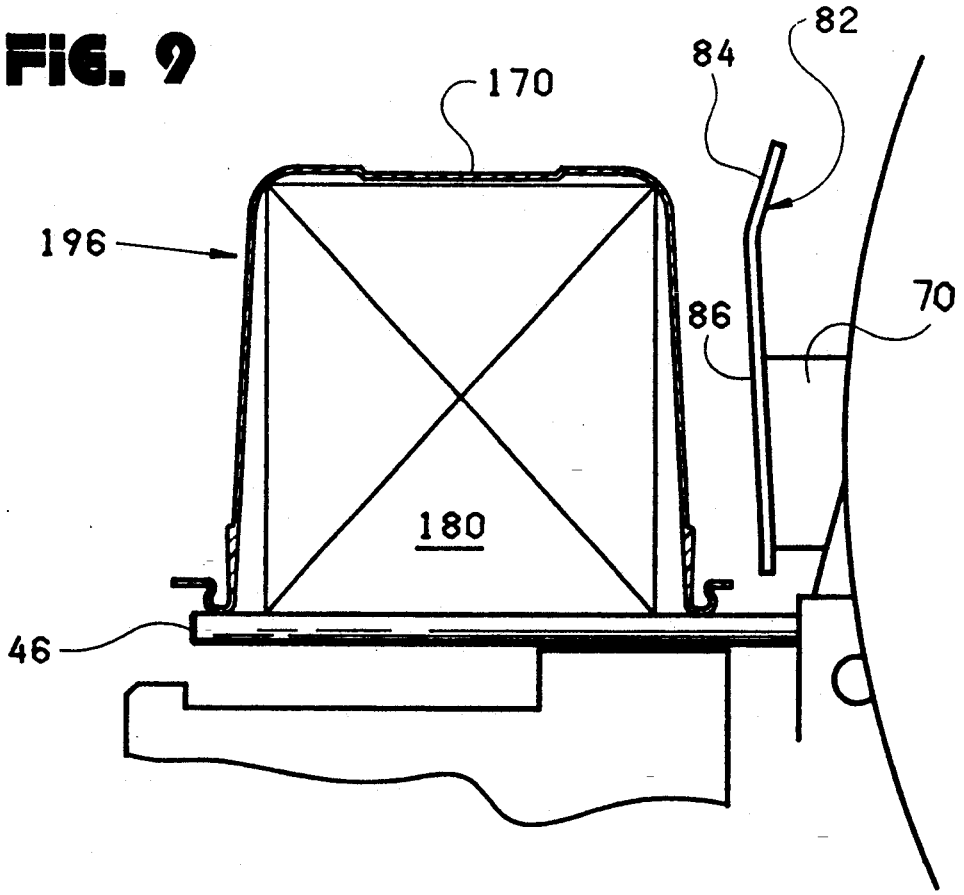
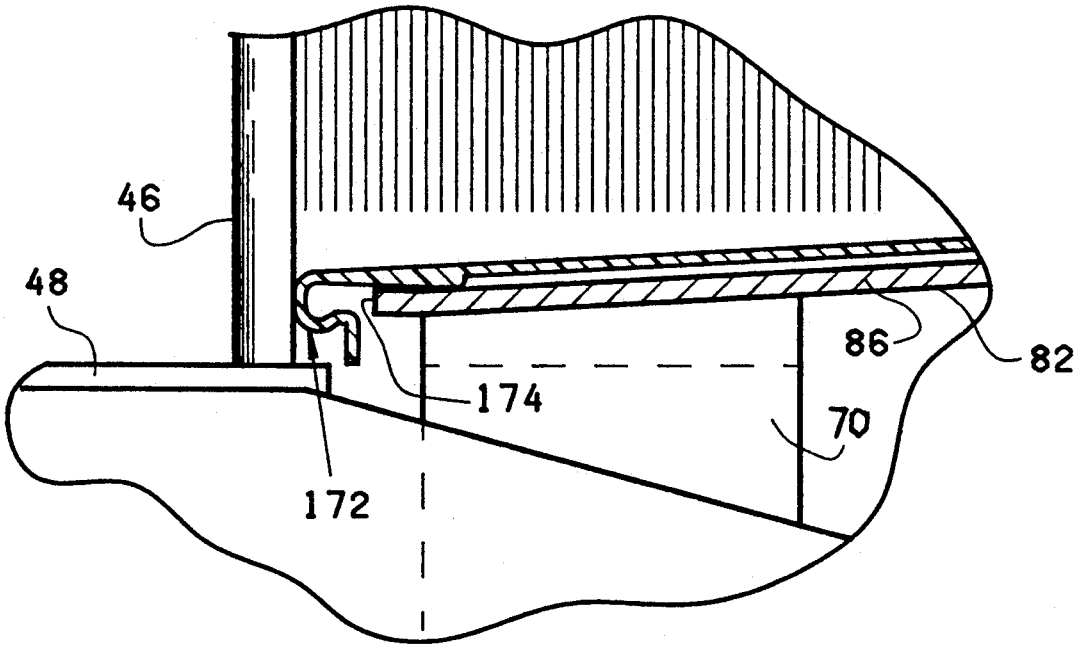
FIG. 10

PACKAGE ASSEMBLY MACHINE AND METHOD

FIELD OF THE INVENTION

The invention relates to an automatic assembly machine and method for continuously placing a series of articles in open hollow containers to form open topped packages. The packages are sealed in a subsequent operation.

DESCRIPTION OF THE PRIOR ART

High speed article production equipment manufactures articles at a very rapid rate. These articles are conventionally moved by conveyor from the production equipment to packaging equipment where the articles are placed in containers and then sealed in the containers. The articles must be packaged at a rate equal to the production rate.

Rapid packaging of a stream of relatively large, wet articles, such as stacks of saturated fabric wipes, is difficult because the articles are dripping wet, limp and very difficult to grip and move. The articles can be moved relatively easily along a conveyor. It is difficult to secure all of the wipes in the stack in order to move the stack from a conveyor for placement in an upstanding open mouthed container. Packaging the saturated stack of wipes is further complicated because the liquid saturating the wipes drips down from the stack during packaging, falls onto the packaging machine and may fall on the outer surface of the container during placement of the stack in the container. Rapid handling of the wet, soft and dripping stack is particularly difficult because of the high production rates at which saturated stacks are delivered for packaging.

SUMMARY OF THE INVENTION

The invention is an automatic packaging machine and method for rapidly placing saturated stacks of fabric wipes or similar articles in open mouth containers to form packages with the stacks resting on the bottoms of the containers. The packages are conveyed away from the machine and sealed.

A stream of stacks is conveyed from the production equipment to the packaging machine along an infeed conveyor assembly with the lead stack positioned at a pick up station. A stream of inverted hollow open-mouth containers, which may be formed of thin walled plastic, is moved by a container infeed conveyor assembly to a loading station located above the pick up station. The lead container is positioned above the lead stack. A continuously moving assembly conveyor includes an upward run extending past the stations.

Operation of the assembly conveyor moves pick up fingers up the run against the bottom of the lead stack to lift the stack from the pick up station and raise the stack up into the lead inverted container at the loading station to form a package. With further movement of the assembly conveyor, the fingers move the package around a 180 degree inversion run to invert the package so that the container is upstanding and the stack is gravity held on the bottom of the container. The stack and container are positively held during the inversion to prevent the stack or container from falling from the conveyor.

Following movement of the package around the inversion run, the package is moved along a downward run of the assembly conveyor opposite the upward run and is discharged on a take away conveyor for transport to a sealing station where a closure is applied to the top of the package.

The assembly machine rapidly and neatly assembles the wet and soft stacks of wipes in the containers and then discharges the package for sealing. Drips are minimized. Handling of the soft, wet and dripping stacks is minimized. After inversion, the liquid in the stacks is trapped within the container to assure that the stacks remain saturated.

Other objects and features of the invention will become apparent as the description proceeds, especially when taken in conjunction with the accompanying drawings illustrating the invention, of which there are eight sheets and one embodiment.

DESCRIPTION OF THE DRAWINGS

FIG. 9 is a front view, showing the package located on the lift finger assembly as it is lifted from the upper infeed conveyor; and FIG. 10 is a front, partially broken away view of the lift finger assembly showing the location of the package along the assembly before the package is inverted.

DESCRIPTION OF THE PREFERRED EMBODIMENT

Figure 1:
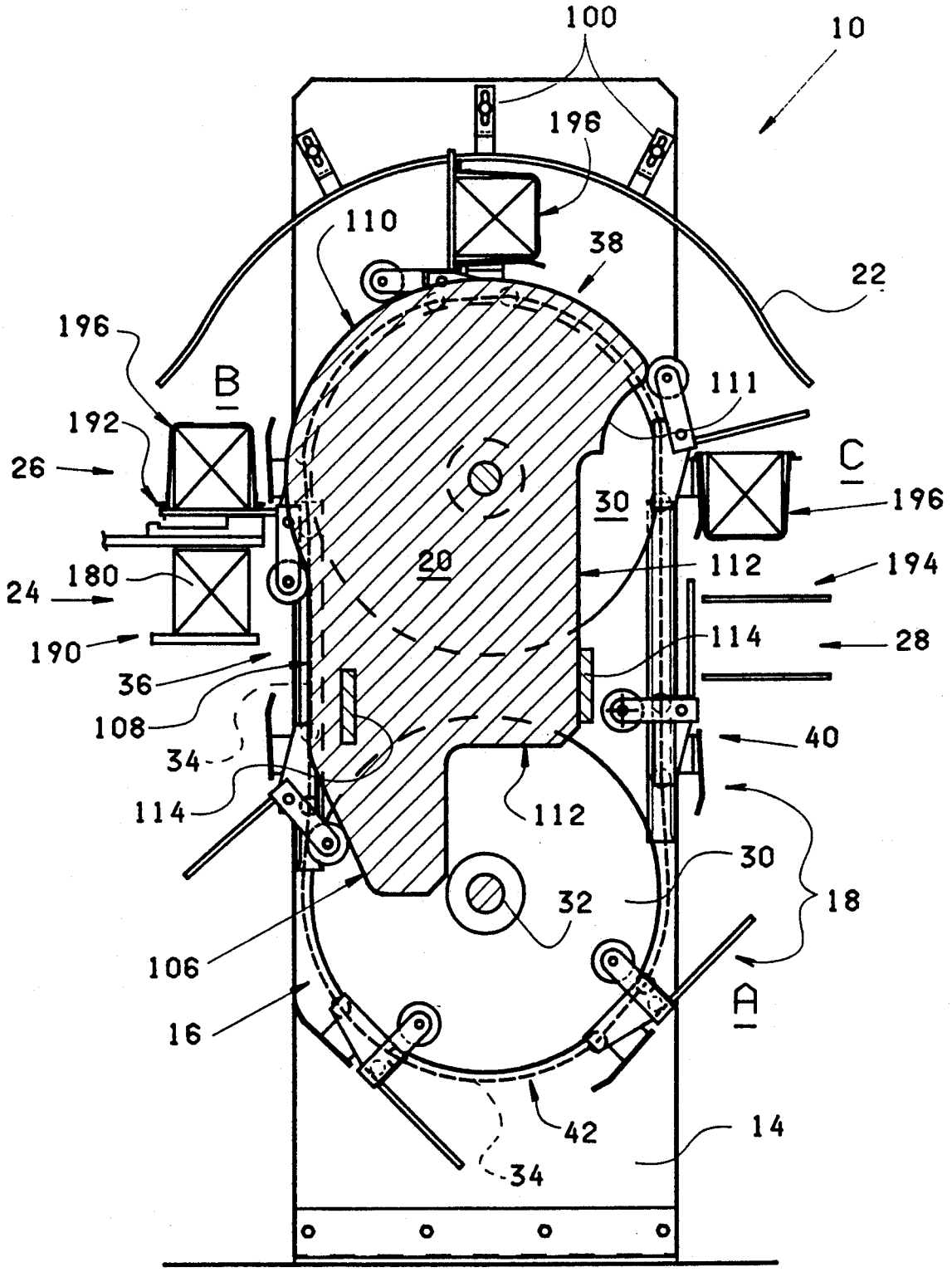
FIG. 1 is a sectional view of the package assembly machine showing the relative positions of the inversion conveyor, lower infeed conveyor, upper infeed conveyor and discharge conveyor.
Figure 2:
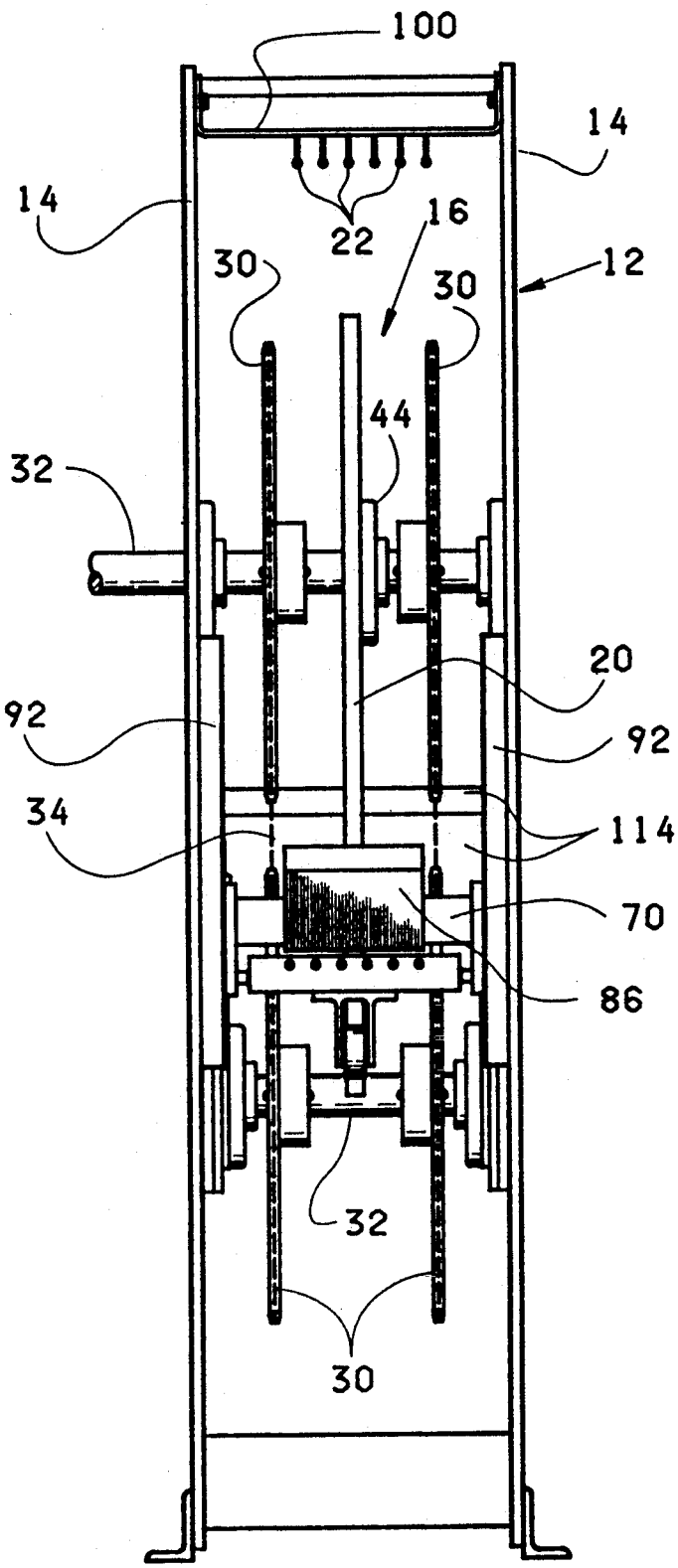
FIG. 2 is a side view of the packaging machine show in FIG. 1, partially broken away.

Package assembly machine 10 includes a fixed frame 12 having a pair of vertically extending parallel sideplates 14. Endless assembly conveyor 16 is located between the sideplates of the frame and surrounds the perimeter of the cam plate 20. Curved guide rods 22 are located above the cam plate and endless conveyor. Seven transport units 18 are mounted on conveyor 16. Package assembly machine 10 also includes article infeed conveyor assembly 24 and container infeed conveyor assembly 26 both located adjacent upward run 36 of the conveyor 16 and package takeaway conveyor 28 located adjacent downward run 40 of the endless conveyor.

Endless conveyor 16 includes parallel upper and lower shafts 32 which each carry a pair of sprocket gears 30. Adjacent sprocket gears on the upper and lower shafts are coplanar. A continuous chain 34 is wrapped around each pair of adjacent sprocket gears. The chains define runs 36, 38, 40 and 42.

Endless conveyor 16 includes a linear upward run 36, a 180 degree semi-circular inversion run 38 which joins the upward run, a linear downward run 40 which also joins the inversion run and is parallel the upward run, and a 180 degree semi-circular return run 42 which joins both the upward and downward runs. The upward run extends past article pick up station 190 and package assembly station 192 located above the article pick up station. Inversion run 38 is located under guide rods 22 and downward run 40 extends past takeaway station 194. See FIG. 1. Shafts 32 as shown in FIG. 1 are rotated clockwise so that each transport unit 18 is moved repetitively along runs 36, 38, 40 and 42.

Cam plate 20 is mounted on cross members 114 and is parallel to sprocket gears 30. Upper shaft 32 extends through the upper portion of plate 20 and is supported by bearing 44. Both cross members are connected to the side plates 14.

Figure 4:
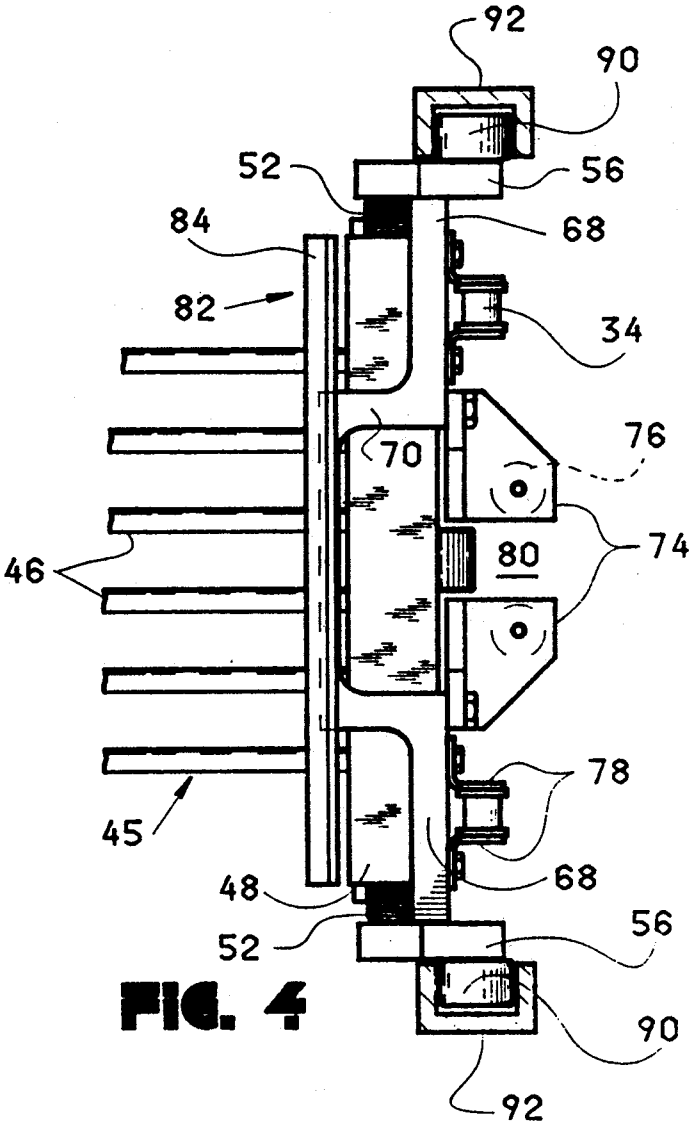
FIG. 4 is a top view of a lift finger assembly.
Figure 3:
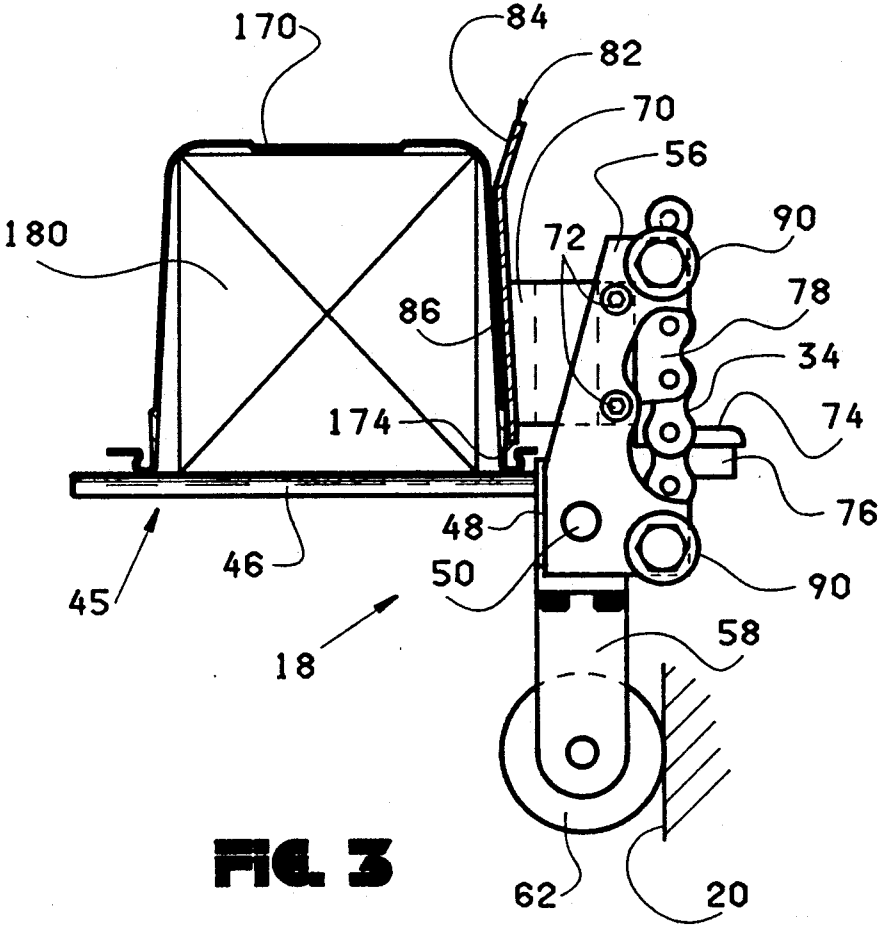
FIG. 3 is a view of a finger assembly supporting a package.

The transport units 18 are connected to chains 34 of endless conveyor 16 at regularly spaced intervals. As shown in FIGS. 3 and 4, each transport unit includes a support 66 having an elongate body 70 extending across conveyor 16 with ends 68 located adjacent chains 34. End flanges 56 are mounted on the ends 68 by bolts. A rod 50 extends between the flanges. The ends of the rod are secured in the flanges. A pair of support rollers 90 are attached to each flange and extend outwardly away from the body. U-shaped tracks 92 are attached to sideplates 14 of frame 12 adjacent upward run 36 and downward run 40 and face the endless conveyor 16. As shown in FIG. 4, the rollers run along the tracks as each transport unit moves along the upward and downward runs. The tracks hold the body 70 in a fixed orientation as the transport unit is moved along runs 36 and 40.

L-shaped brackets 78 are fastened to body 70 and join the body to chains 34. The connection of the transport units to the chains is shown in FIG. 4. L-shaped plates 74 are attached to body 70 inwardly of chains 34. The plates define central slot 80. A bumper 76 is mounted on each plate and faces away from the direction of movement of conveyor 16. Cam plate 20 extends into slot 80 as the transport unit 18 moves around conveyor 16.

A plate 82 is mounted on the body 70 and faced outwardly of conveyor 16. The support plate includes a lead in 84 and a contact face 86. As shown in FIG. 3, the contact face slopes inward toward body 70 to conform to the adjacent surface of the package on unit 18. Lead in 84 tapers inward as it extends away from contact face 86. Lock edge 174 is located at the bottom of plate 82 away from lead in 84.

Each transport unit 18 includes a rotatable finger assembly 45 mounted on rod 50. The assembly includes block 48 and a plurality of spaced apart fingers 46 which extend outwardly from the block. Rod 50 extends through the block. Springs 52 surround the rod 50 between the flanges 56 and block 48 and are connected to the flanges and block to bias the finger assembly toward retracted position A shown in FIG. 1. The fingers are movable from the retracted position and an extended position by cam plate 20. In the retracted position, the fingers are rotated adjacent chains 34. In the extended position B of FIG. 1, the fingers extend perpendicularly away from chains 34. Articles 180 and containers 170 are supported by the fingers as the transport unit moves up run 36 and around inversion run 38. The number of fingers mounted on the block is determined by the size of the articles which are supported by the fingers.

In each unit 18 a rotary cam follower 62 is mounted on the free end of an arm 58 on block 48. In the retracted position A, the springs 52 hold the arm and follower inwardly of chains 34 and arm 58 contacts bumpers 76. Movement of the finger assembly along conveyor 16 brings the follower 62 into intermittent engagement with the surface of ca plate 20 and rotates the finger assembly from the retracted position to the extended position.

As shown in FIG. 1, cam plate 20 has an outwardly facing circumferential cam surface including an outwardly sloped rise segment 106 adjacent the lower end of run 36, a straight dwell segment 108 extending along run 36, a 180 degree semi-circular dwell segment 110 extending along run 38, a fall segment 111 and a return segment 112 which joins segments 111 and 106.

A plurality of arcuate guide rods 22 form a 180 degree semi-circle above inversion run 38 of endless conveyor 16. The guide rods locate the package on each transport unit as the transport unit moves along the inversion run of the endless conveyor. The rods are held above the conveyor by brackets 100 which join sideplate 14. The leading and trailing ends of rods 22 are bent outwardly. The ends of fingers 46 extend between rods 22 as units 18 move around run 38.

Figure 5:
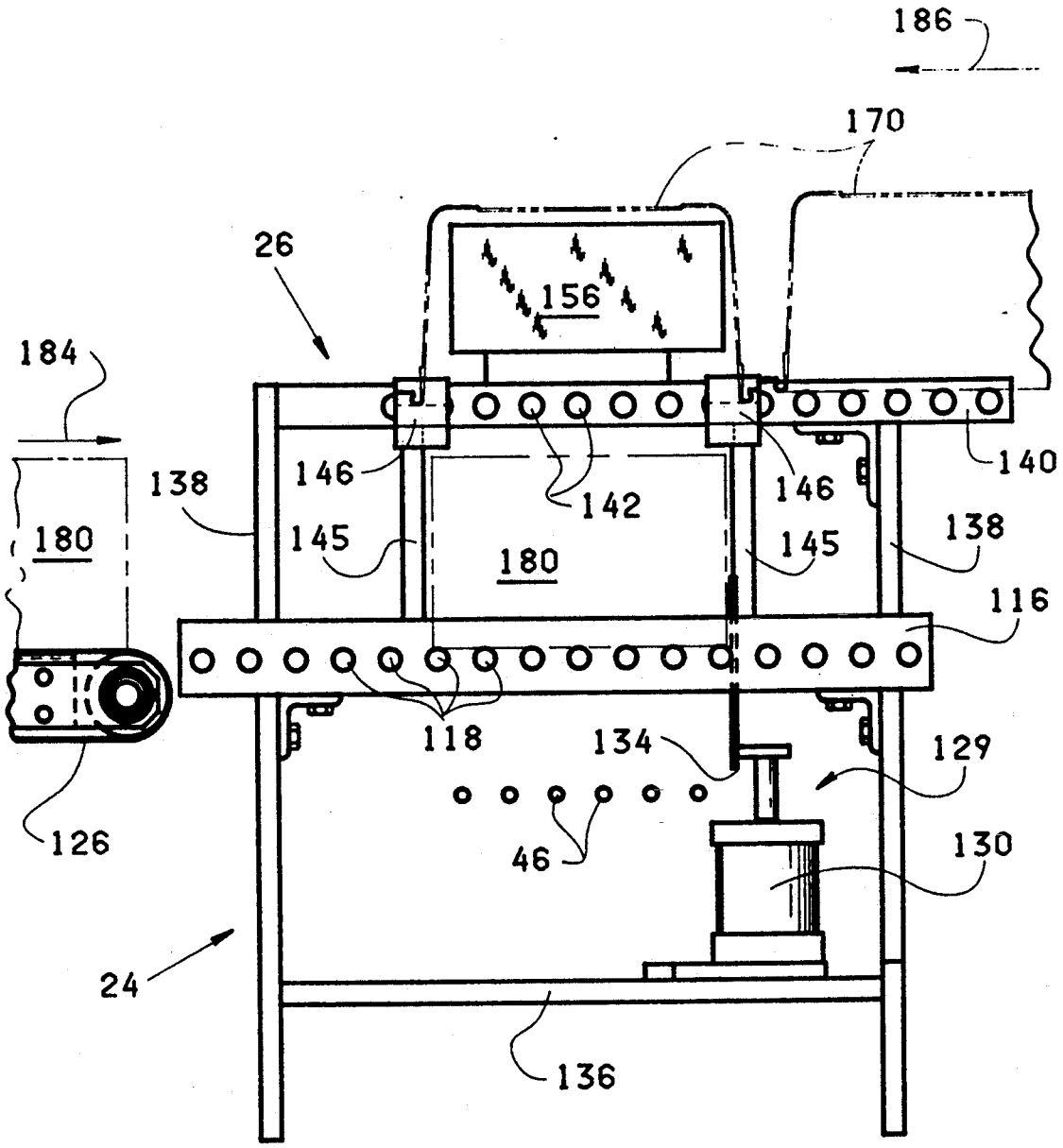
FIG. 5 is a front view of the upper and lower infeed conveyors, taken along line 5—5 of FIG. 4.
Figure 6:
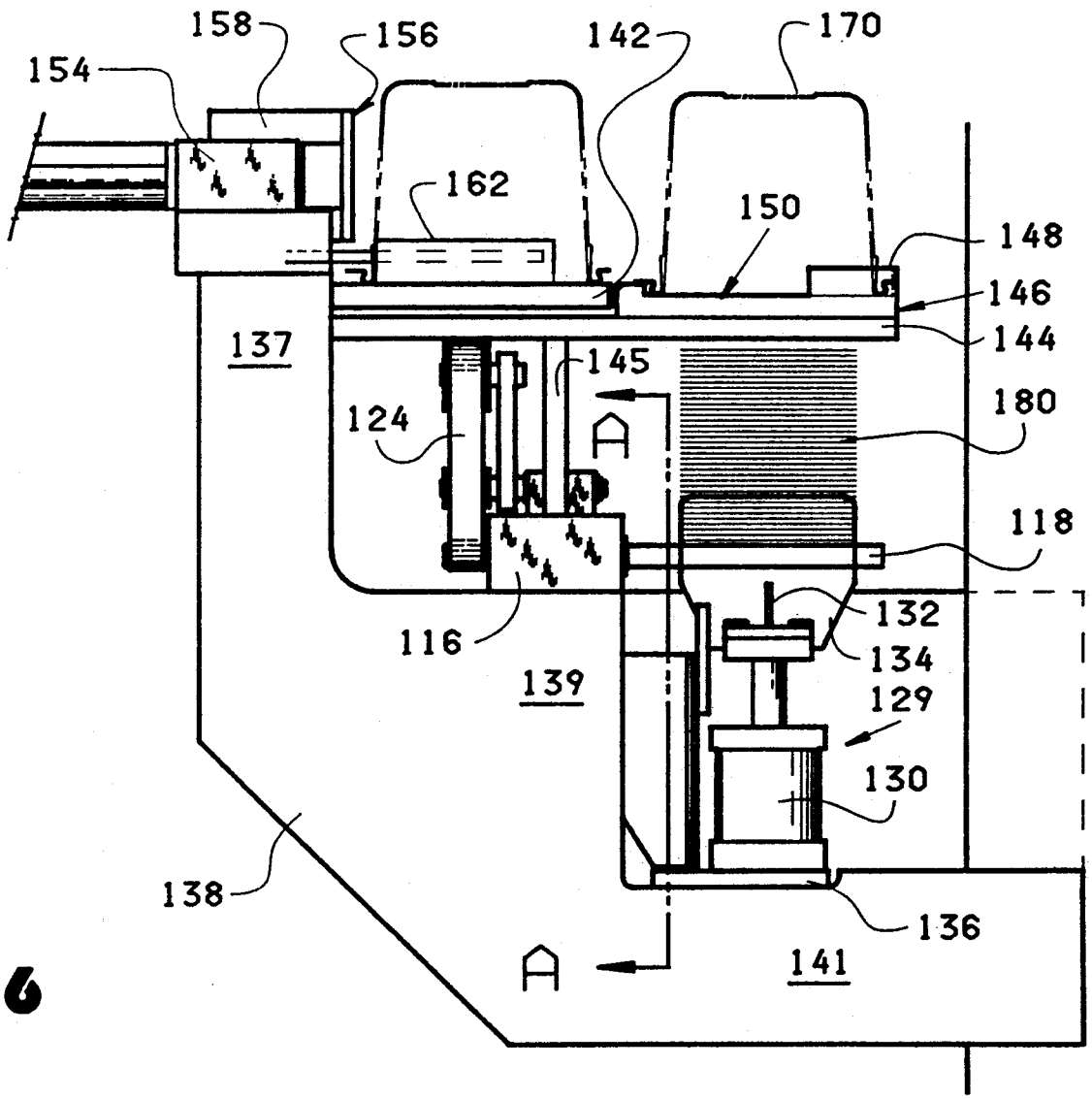
FIG. 6 is a side view of the upper and lower infeed conveyors, taken along line 6—6 of FIG. 5.

Article infeed assembly 24 moves rectangular stacks of saturated fabric 180 from a stack making machine horizontally toward the endless conveyor and article pick up station 190, in a direction indicated by arrow 184 in FIG. 5. The assembly 24 is located outside of and extends perpendicular to run 36 of endless conveyor 16. The assembly includes a rectangular bar 116 supported along each end by three-stepped plates 138. As shown in FIG. 6, the bar is supported at its ends by the second step 139 of each plate. A plurality of parallel rotatable support rods 118 are rotatably mounted in the bar. Each rod passe through the bar and has a first support end which extends away from the bar toward endless conveyor 16 and a second drive end which extends outwardly from the bar away from the endless conveyor. Each rod is spaced from adjacent rods by a distance approximately equal to the diameter of the rod.

A plurality of parallel rotatable idler rods 120 are also rotatably mounted in rectangular bar 116. The idler rods extend outwardly from the bar 116 away from endless conveyor 16 below the drive ends of the rods 118.

A belt drive rotates rods 118. The drive includes belt 124 and tensioning pulleys 121 and 123 which are located directly above idler rods 120 and the second end of rods 118. The belt is fed between rods 118 and 120, around pulleys 121 and 123 and around a drive pulley 128 on the end roller of conveyor 125. Conveyor 125 moves the articles 180. The rods 118 are aligned with the top of conveyor belt 126 so that as article 180 moves to the end of the conveyor belt, it smoothly translates onto and moves along the support ends of the rods.

Article stop 129 is located below the support ends of rods 118 on horizontal platform 136 which is, in turn, supported by steps 141 of support plates 138. The stop 129 includes reciprocating cylinder 130 which is attached to a vertical plate 134. The cylinder moves the plate between an elevated stop position above rods 118 and a retracted position below the rods. Movement of the articles 180 along the rods 118 is stopped by elevated plate 134.

Container infeed conveyor assembly 26, moves inverted open topped plastic containers 170 to the package assembly station 192. The containers are moved toward the station in the direction of arrow 186 shown in FIG. 5, opposite to the direction that articles 180 are moved to the article pick up station 190. The infeed assembly is adjacent upward run 36 of endless conveyor 16 and is located above and extends parallel to article infeed conveyor assembly 24.

Thin walled plastic container 180 has inwardly tapered sidewalls, a closed bottom, an open top and a hook-shaped circumferential lip 172 extending around the outside of the top. The opening in the hook lip faces the bottom of the container. The lip is shown in FIG. 10.

Figure 7:
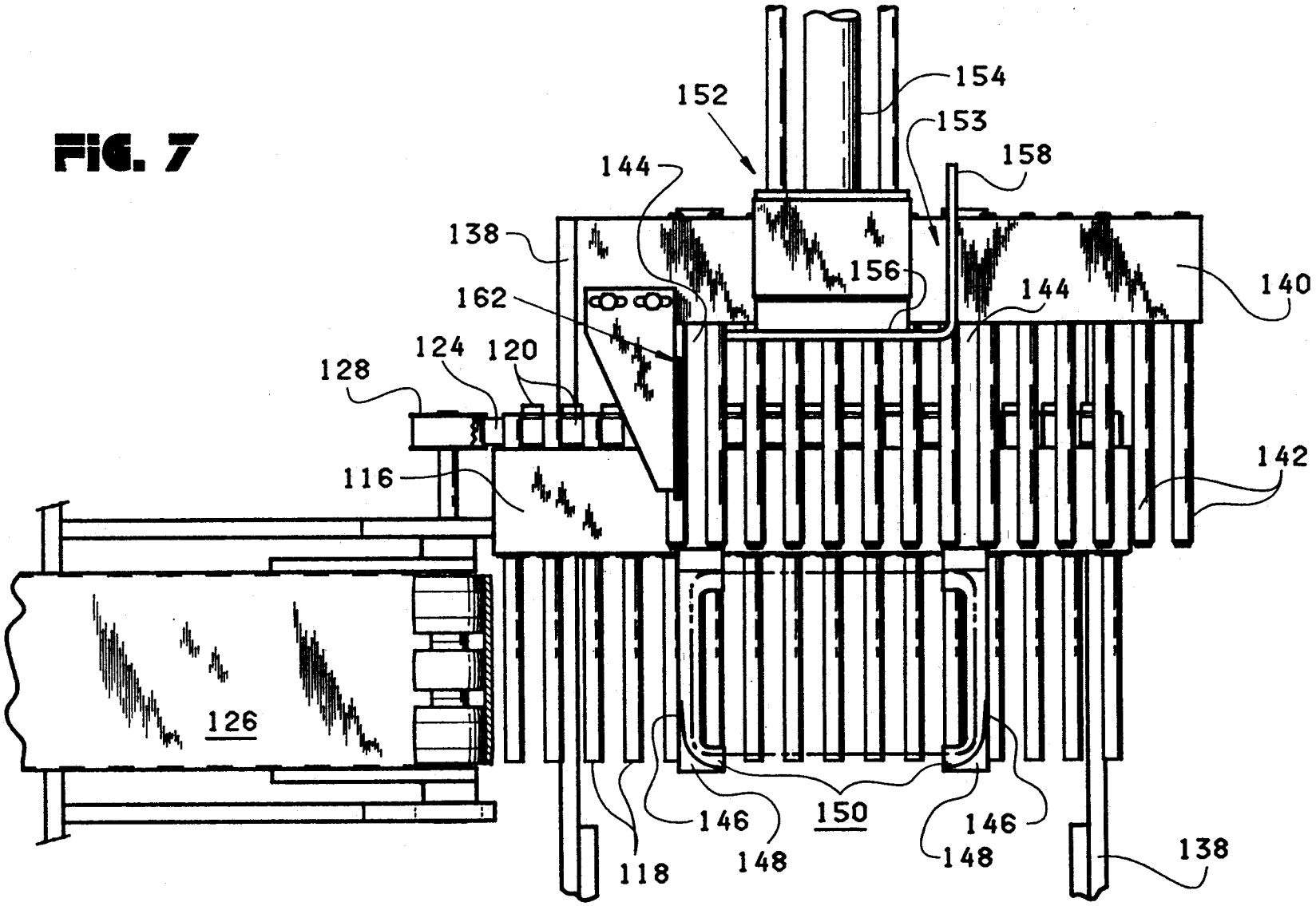
FIG. 7 is a top view of the upper and lower infeed conveyors, taken along line 7—7 of FIG. 5.
Figure 8:
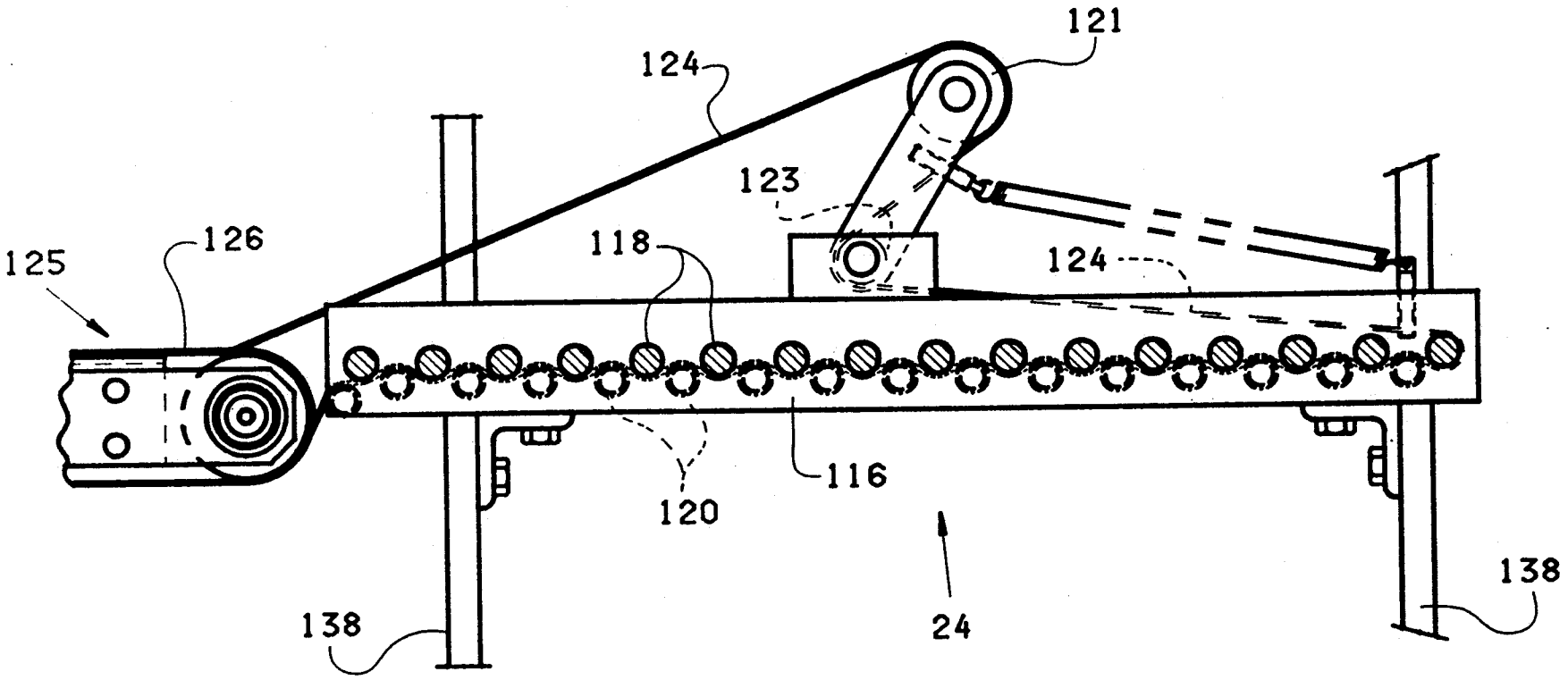
FIG. 8 is a view of the lower infeed conveyor, taken along line 8—8 of FIG. 7.

Infeed assembly 26 includes a horizontal bar 140 supported on the third steps 137 of support members 138. A plurality of parallel rods 142 are rotatably mounted in the bar and extend outwardly toward endless conveyor 16. As shown in FIG. 7, rods 142 are offset to the side of rods 118 away from conveyor 16. Each rod is provided with a nylon sleeve to reduce friction with containers.

Container pusher 152 is mounted on top of bar 140 and includes cylinder 154 and an L-shaped pusher plate 153 attached to the cylinder. The L-shaped plate includes pushing face 156 and stop face 158 perpendicular to the push face. The pusher face parallels the direction which containers 170 move along rods 142 while stop face 158 is perpendicular to the direction the containers move along the rods.

Vertical stop plate 162 is mounted on bar 140 at a position downstream from the pusher 152 and above rods 142 in the path of movement of the containers 170. The plate stops movement of the lead container in front of the pusher.

Container infeed conveyor assembly 26 includes a pair of parallel support arms 144. Each arm 144 is mounted on a vertical member 145 located between support members 138. The arms extend outwardly away from the rods 142 toward endless conveyor 16 at a level below the rods. The arms are directly above article pick up station 190 and define package assembly station 192

A C-shaped nesting support 146 is mounted on top of the outer end of each arm 144 adjacent endless conveyor 16. Each support 146 includes a recessed nesting floor 150 and a vertically-extending nesting stop 148. The nesting supports locate the plastic containers at package assembly station 192.

Package takeaway conveyor 28 is located adjacent downward run 40 of conveyor 16 at takeaway station 194. The takeaway conveyor includes a conventional conveyor belt supported by rotary members. The takeaway conveyor moves assembled upright packages away from the package assembly machine toward a machine which seals closed the tops of the packages.

The operation of the package assembly machine will now be described by following the movement of one transport unit around the conveyor.

A conventional rotary drive means (not illustrated) rotates upper shaft of conveyor 16 to move the chains and units 18 around runs 36–42.

As transport unit 18 approaches the upward run 36, the fingers are held in the retracted position by springs 52 and follower 62 extends inwardly between the chains 34. When the transport unit moves to the beginning of upward run 36, rotary cam follower 62 contacts and moves along the cam rise segment 106 thereby rotating the finger assembly and moving the fingers to the extended position. Support rollers 90 in tracks 92 hold the transport unit as the assembly is moved and springs 52 are stressed. When the transport unit moves from the rise segment to the bottom of straight dwell segment 108, fingers 46 are in the extended position below the article pick up station 190.

Before transport unit 18 moves up to station 190 an article 180, which may be a saturated stack of wipes, is moved along conveyor 24 toward conveyor 16 and article station 190. The stack moves from conveyor belt 126 onto the support ends of rods 118 until contacting vertical plate 134. Plate 134 stops article 180 at article pick up station 190 below container package assembly station 192. If the article does not meet the proper specifications for the package, the plate can be lowered allowing the article to continue to move downstream and fall into a receptacle. Upward movement of the extended fingers moves the fingers through the openings between rods 118 to pick up article 180 from station 190.

An inverted plastic container 170 is moved to the package assembly station 192 before the fingers raise the article to the station. A stream of containers is moved along rods 142 toward stop plate 162 and the lead container is held against the plate. Extension of cylinder 154 moves plate 156 toward conveyor 16 to push the lead container only laterally onto arms 146 and into the assembly station. The stops 148 on the ends of the arms locate the container at the station. The new lead container in the stream of containers is held against plate 158 during extension of the cylinder. Retraction of the cylinder allows the new lead container to be moved forward to stop plate 162 for subsequent movement to the loading station when cylinder 154 is again extended.

Continued upward movement of fingers 46 and supported article raise the article upwardly between the arms 146 and positions the article into the hollow interior of the inverted body 170 held on the arms at the package assembly station 192 and form a package 196 as illustrated in FIG. 9. The package is supported on the fingers a distance outwardly from the support plate 82.

During pick up of the container by fingers 46 the inwardly bent lead in 84 on the top of plate 86 bent toward the chains freely passes the container as the article 180 is moved into the container held at the package assembly station 192.

Further movement of chains 34 moves the transport unit 18 and supported package 196 vertically upwardly along run 36 and then around the 180 degree inversion run 38. During movement of the transport unit along the upwardly vertical run 36 and the inversion run 38, follower 62 engages the dwell segments 108 and 110 on the circumference of cam plate 20 to hold the fingers perpendicularly outwardly from the chain.

As the transport unit carrying package 196 is rotated around the inversion run 18, the fingers 46 supporting the package are rotated from the horizontal upwardly to the vertical and then back to the horizontal at the end of the inversion run. As the package 196 is moved around the run, the fingers 46 pass through guide rods 22 and the rods engage the side of the package located outwardly of the chains 34 to shift the package inwardly and downwardly along the upwardly rotating fingers 46 from the position shown in FIG. 9 to the position shown in FIG. 10 where the hook lip 172 of the container on the inside of the package is positioned immediately under the lower edge 174 of plate 82. FIG. 10 illustrates the position of the fingers, plate and package at the 12 o'clock position on top of the conveyor as shown in FIG. 1. The package 194 also freely slides inwardly along the raised fingers 46 from the position of FIG. 9 to the position of FIG. 10. The inner side of the container in the package rests flush on the contact face 86 of plate 82.

Continued movement of the transport unit 18 around the conveyor rotates the fingers and plate 82 in a clockwise position as illustrated in FIG. 1. With such rotation the package slides down along surface 86 of the plate 82 to move the adjacent container hook lip 172 over plate edge 174 and thereby support the package 196 on the edge of the plate 82. Rods 22 prevent the package 196 from moving radially outwardly away from the plate during gravity shifting and engagement of the lip 172 around the edge 174.

During movement of the transport unit 18 to the end of the inversion run and onto the downward run the cam follower for the unit moves along the semi-circular dwell surface 110 and then is biased inwardly to the fall segment 111 by springs 52. Movement of the follower onto the fall segment 111 rotates the fingers 46 from the extended position above the package 196 and perpendicular to the chains to the retracted position adjacent the chain to permit unloading of the package onto the takeaway conveyor 28 at takeaway station 194.

Movement of the unit 18 to the downward run 40 of the conveyor moves the rollers 90 into the track 92 adjacent the run to stabilize the unit with the bottom of the container in the package extending parallel to the upper run of the takeaway conveyor. As the unit 18 is moved down past the takeaway conveyor the bottom of the package engages the upper run of conveyor 28 and is supported on the run until the unit 18 moves down sufficiently to move edge 174 of plate 82 out of the hook lip 174, thereby freeing the package. At this time, fingers 46 are retracted position free of the package supported on the conveyor. Upon disengagement of the package from the transport unit 18 the package is moved with the run away from machine 10 and toward a sealing machine which affixes an appropriate closure to cover the upper open end of the container and thereby seal the article in the container.

Following discharge of the package, the transport unit 18 is moved down the remainder of run 40 and around the return run 42 and the cycle of operation is repeated.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention is:

1. A package assembly machine comprising:

a) an endless conveyor including a transport unit and a drive for repetitively moving the transport unit around a path including an upward run, an inversion run and a downward run;

b) article infeed conveyor means for positioning successive articles at an article pick up station located adjacent the upward run of the conveyor;

c) container infeed conveyor means for positioning successive inverted containers at a package assembly station located adjacent the upward run of the conveyor above the article pick up station; and d) package takeaway conveyor means for removing upright packages from the transport unit at a takeaway station located on the path of movement of the transport unit;

e) the transport unit including an article lift member movable through the article pick up station and the package assembly station to pick up an article on the article infeed conveyor means, move the article up and into an inverted container on the container infeed conveyor means to form an inverted package and carry the package to the inversion run, and package retention means engagable with the package during movement of the transport unit along the inversion run for holding the package on the transport unit during movement to the takeaway station.

2. A package assembly machine as in claim 1 wherein the article infeed conveyor means includes a plurality of spaced apart article support members extending across the article pick up station; the container infeed conveyor means includes two container support members located on opposite sides of the package assembly station; and the transport unit includes a body and the lift member includes a plurality of spaced fingers extending outwardly from the body.

3. A package assembly machine as in claim 2 including actuation means for moving the fingers away from the package before the transport unit moves past the package takeaway conveyor.

4. A package assembly machine as in claim 2 including a rotary connection joining the fingers to the body and permitting movement of the fingers between a first position extending away from the path and a second position adjacent to the path, a cam and follower drive for moving the fingers toward one of said positions, and a spring biasing the fingers toward the other of said positions.

5. A package assembly machine as in claim 2 wherein the article infeed conveyor means comprises a number of support rollers, a drive for rotating the rollers to move an article to the article pick up station, and a stop member above the rollers at one side of the article pick up station for stopping an article at such station.

6. A package assembly machine as in claim 5 including means for withdrawing the stop member from above the rollers to permit feeding an article past the article pick up station.

7. A package assembly machine as in claim 2 wherein the container infeed conveyor means includes a container infeed conveyor located to one side of the package assembly station, a stop on the end of such conveyor and a pushing member movable across such conveyor adjacent the stop for moving a lead inverted container onto the container support members.

8. A package assembly machine as in claim 1 wherein the package retention means comprises a support plate facing outwardly of the path and including a container-engaging edge on the side of the plate facing away from the direction of movement of the transport unit around the path.

9. A package assembly machine as in claim 8 including a retention member extending along the inversion run a distance outwardly from the path for confining a package on the transport unit.

10. A package assembly machine as in claim 1 wherein the drive includes a continuous member extending around the path, a plurality of article transfer units like said transport unit secured to the member at spaced intervals along the member, each article transport unit including a body having a package support plate, said retention means comprising an edge on the support plate, said lift member comprising a finger assembly movably mounted on the body having a plurality of parallel and spaced apart fingers extending away from the body, a cam follower on the finger assembly, and a spring connected between the body and the finger assembly biasing the finger assembly toward a position with the fingers adjacent the continuous member; a cam plate mounted on the assembly machine adjacent the continuous member, said plate including a dwell surface extending along the upward and inversion runs in the conveyor assembly engagable with said cam follower to move the finger assembly to a position with the fingers extending away from the member.

11. A package assembly machine as in claim 1 wherein said transport unit includes a package support plate.

12. A package assembly machine as in claim 11 wherein the package retention means comprises an edge on said plate.

13. A package assembly machine as in claim 1 wherein said takeaway location is adjacent the downward run of the conveyor.

14. A package assembly machine as in claim 1 including engagement means for moving the package into engagement with the retention means as the transport unit moves along the inversion run.

15. A package assembly machine as in claim 14 wherein said engagement means comprises an elongate member extending along the inversion run.

16. A package assembly machine comprising a frame, an endless conveyor mounted on the frame, the conveyor including an upward run, an inversion run at the top of the conveyor, a downward run and a return run at the bottom of the conveyor; a plurality of like transport units space around the conveyor; a conveyor drive for moving the units repetitively along the runs; each unit including a body mounted on the conveyor, package retention means engagable with a package during movement along the inversion run, a lift unit, a pivot connection joining the lift unit to the body to permit movement of the lift unit between a retracted position adjacent the conveyor and an extended position located outwardly of the conveyor; article infeed conveyor means for positioning successive articles at an article pick up station locate adjacent the upward run of the conveyor; container infeed conveyor means for positioning successive inverted containers at a package assembly station located adjacent the upward run of the conveyor above the article pick up station; package takeaway conveyor means for removing upright packages from the transport unite after inversion; lift unit positioning means for holding the package lift units in the extended position during movement along the upward run and around the inversion run and for holding the package lift units in the retraced position during movement past the takeaway station.

17. A package assembly machine as in claim 14 including package shifting means for moving a package into engagement with said package retention means as the package is moved along the inversion run.

18. A package assembly machine as in claim 17 wherein said package shifting means comprises an elongate member extending along the inversion run.

19. A package assembly machine as in claim 17 wherein the package shifting means is located on the outside of the inversion run and the package retention means is located on the inside of the inversion run.

20. A package assembly machine as in claim 17 wherein said package retention means comprises a plate having an edge.

21. The method of placing an article in an open-mouthed container to make a package comprising the steps of:

a) moving a stream of articles along a conveyor to position a lead article at an article pick up station;

b) moving a stream of inverted hollow open-mouthed containers along a conveyor to position a lead container at a package assembly station located above the article pick up station;

c) moving a first support member up under the lead article to raise the lead article above the article pick up station, place the article into the lead conveyor at the assembly station and form an inverted package on the first support member;

d) rotating the inverted package through an angle of substantially 180 degrees to move the mouth of the container from the bottom of the package to the top of the package so that the package is upright and the article is gravity-held within the container;

e) transferring the package from the first support member to a second support member holding the package in the upright position during step d); and f) moving the second support member and held upright package to a takeaway station, disengaging the package from the second support member, placing the article on a conveyor at the takeaway station and moving the upright package from the takeaway station on the conveyor.

22. The method of claim 21 including the step of withdrawing the first support member away from the upright package as the package is moved to the takeaway station.

23. The method of claim 21 including the step of positioning the second support member away from the package at the package assembly station and then moving the package into engagement with the second support member during step d).

24. The method of claim 21 including the step of moving the package along an arcuate path during step d).

25. The method of claim 21 including the step of supporting opposed edges of the lead inverted package at the package assembly station.

26. The method of claim 21 wherein the container includes a recessed lip and including the step of moving the second support member into the lip.

* * * * *

UNITED STATES PATENT AND TRADEMARK OFFICE

CERTIFICATE OF CORRECTION

PATENT NO. : 5,255,493

DATED : October 26, 1993

INVENTOR(S) : Robert E. Molison et al

It is certified that error appears in the above-identified patent and that said Letters Patent is hereby corrected as shown below:

Column 3, line 52, change "and" to --to--.

Column 3, line 68, change "ca" to --cam--.

Column 4, line 30, change "passe" to --passes--.

Column 6, line 49, change "18" to --38--.

Column 7, line 3, change "position" to --direction--.

Column 7, line 19, change "chain" to --chains--.

Column 7, line 30, change 174" to --172--.

Column 7, line 31, before "retracted", insert --in the--.

Column 9:

Claim 16, line 6, change "space" to --spaced--.

Claim 16, line 16, change "locate" to --located--.

Claim 16, line 22, change "unite" to --units--.

Claim 17, line 1, change "14" to --16--.

UNITED STATES PATENT AND TRADEMARK OFFICE

CERTIFICATE OF CORRECTION

PATENT NO. : 5,255,493
DATED : October 26, 1993
INVENTOR(S) : Robert E. Molison, et al.

It is certified that error appears in the above-indentified patent and that said Letters Patent is hereby corrected as shown below:

Column 9, claim 24, line 1, change "21" to read--22--.

Signed and Sealed this

Twentieth Day of September, 1994

*Attest:*

*Attesting Officer*

Bruce Lehman

BRUCE LEHMAN

*Commissioner of Patents and Trademarks*